US006243883B1

(12) United States Patent
Boggs

(10) Patent No.: US 6,243,883 B1
(45) Date of Patent: Jun. 12, 2001

(54) SOCCER PROTECTIVE GEAR

(75) Inventor: Lisa Boggs, 10860 Big Bone Rd., Union, KY (US) 41042

(73) Assignee: Lisa Boggs, Union, KY (US)

( * ) Notice: Subject to any disclaimer, the term of this patent is extended or adjusted under 35 U.S.C. 154(b) by 0 days.

(21) Appl. No.: 09/619,823

(22) Filed: Jul. 20, 2000

(51) Int. Cl.[7] ..... A41D 13/00
(52) U.S. Cl. ..... 2/464; 2/92; 128/96.1
(58) Field of Search ..... 2/455, 463, 464, 2/465, 467, 92, 913, 311, 338, 44; 128/95.1, 96.1, 99.1, 100.1, 875, 876; 602/19, 20

(56) References Cited

U.S. PATENT DOCUMENTS

| | | | | |
|---|---|---|---|---|
| 1,774,739 | * | 9/1930 | Voyne | 2/455 |
| 2,249,966 | * | 7/1941 | Matthews | 2/455 |
| 2,338,535 | | 1/1944 | Pfleumer . | |
| 3,162,861 | * | 12/1964 | Gustafson | 2/455 |
| 3,500,472 | | 3/1970 | Castellani . | |
| 3,598,114 | * | 8/1971 | Lewis | 128/78 |
| 3,909,847 | | 10/1975 | Holt . | |
| 3,921,222 | * | 11/1975 | Hollman | 2/455 |
| 3,945,041 | * | 3/1976 | Rhee | 2/455 |
| 4,022,197 | * | 5/1977 | Castiglia | 128/101 |
| 4,084,264 | | 4/1978 | Marion . | |
| 4,100,620 | | 7/1978 | Pecoraro . | |
| 4,302,847 | | 12/1981 | Miles . | |
| 4,441,211 | | 4/1984 | Donzis . | |
| 4,481,679 | * | 11/1984 | Hayes | 2/455 |
| 4,697,285 | | 10/1987 | Sylvester . | |
| 4,761,834 | | 8/1988 | Kolb . | |
| 4,807,301 | | 2/1989 | Ferber . | |
| 4,866,789 | | 9/1989 | Dorm . | |
| 4,872,215 | | 10/1989 | Sliger . | |
| 4,884,295 | | 12/1989 | Cox . | |
| 5,241,704 | * | 9/1993 | Sydor | 2/44 |
| 5,465,423 | | 11/1995 | Taylor-Varney . | |
| 5,465,424 | | 11/1995 | Cudney et al. . | |
| 5,619,747 | | 4/1997 | Boisclair et al. . | |
| 6,098,208 | * | 8/2000 | Cordon | 2/455 |

* cited by examiner

*Primary Examiner*—John J. Calvert
*Assistant Examiner*—Tejash Patel
(74) *Attorney, Agent, or Firm*—Wood, Herron & Evans, LLP

(57) ABSTRACT

A protective device adapted particularly for use by a soccer player includes a front and rear panel connected to each other by elastic straps. The front panel includes a protective portion primarily adapted to protect only the stomach area beneath the rib cage and the rear panel is adapted to provide protection primarily to the kidney areas. The rear panel rests at the waist of the individual keeping it in proper position. This can provide significant protection to the soccer player without being so obtrusive as to be not worn by the soccer player.

7 Claims, 1 Drawing Sheet

SOCCER PROTECTIVE GEAR

BACKGROUND

Soccer is one of the most popular sports in the world. Although it is considered a safe sport, in fact, it is the source of numerous injuries to young and old players alike. Due to the nature of the game, soccer players do not wear protective gear. Bulky protective gear interferes with the quick pace of the game.

Many soccer players are injured and even die each year from abdominal injuries and, in particular, injuries to the kidneys. It is very common for a soccer player to be kicked by an opponent almost anywhere in the body from the legs, which are adapted to take more severe blows, up to the rib cage. The rib cage protects internal organs. The stomach area and kidneys are not protected by bones.

There have been many different types of protective wear that have been designed for different sports, such as football and the like. For example, Matthews U.S. Pat. No. 2,249,966 discloses a stomach protector primarily for a football player. It is a wrap-around device which provides no protection for the kidneys. Gustafson U.S. Pat. No. 3,162,861 discloses a bulky single rubber member which can wrap around the player. It is used to protect the back of the player but is simply too bulky to be used for a soccer player. This is also the case with Castiglia U.S. Pat. No. 4,022,197. Further, Voyne U.S. Pat. No. 1,774,739 discloses a device which protects the kidneys but does not protect the abdomen. Further it is relatively bulky and provides unnecessary protection for the hip area.

SUMMARY OF THE INVENTION

The present invention is premised on the realization that a non-intrusive, effective protective gear can be designed for use by a soccer player which is sufficiently non-intrusive as to be used by a soccer player. The protective gear includes separate front and rear protective panels connected by flexible, stretchable strips. The front panel has a portion designed to cover the abdominal area basically from the pelvic bone up to the rib cage and the rear member is designed to rest on the waistline and extend up and cover an area which effectively protects the kidneys. The panels are formed from a light-weight cellular material which is laminated to cloth providing maximum flexibility, minimal weight and effective protection to the abdominal region and kidney regions of the individual. Further, due to the design, it should automatically stay in position and does not have to be extremely tightly bound to the wearer. Further, this is designed to be worn directly on the wearer's body without any type of attachment to the clothing which permits it to be used with current soccer wear without any further modification.

The present invention will be further appreciated in light of the following detailed description and drawings in which:

DETAILED DESCRIPTION

As shown in the figures, the present invention is soccer protective wear 12 which is adapted to be worn at the waist

Figure 1:
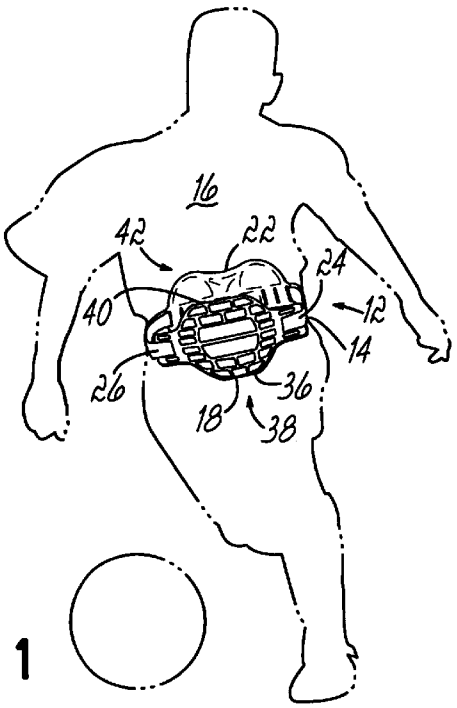
FIG. 1 is a diagramatic view of a soccer player in phantom wearing the apparatus of the present invention.
Figure 2:
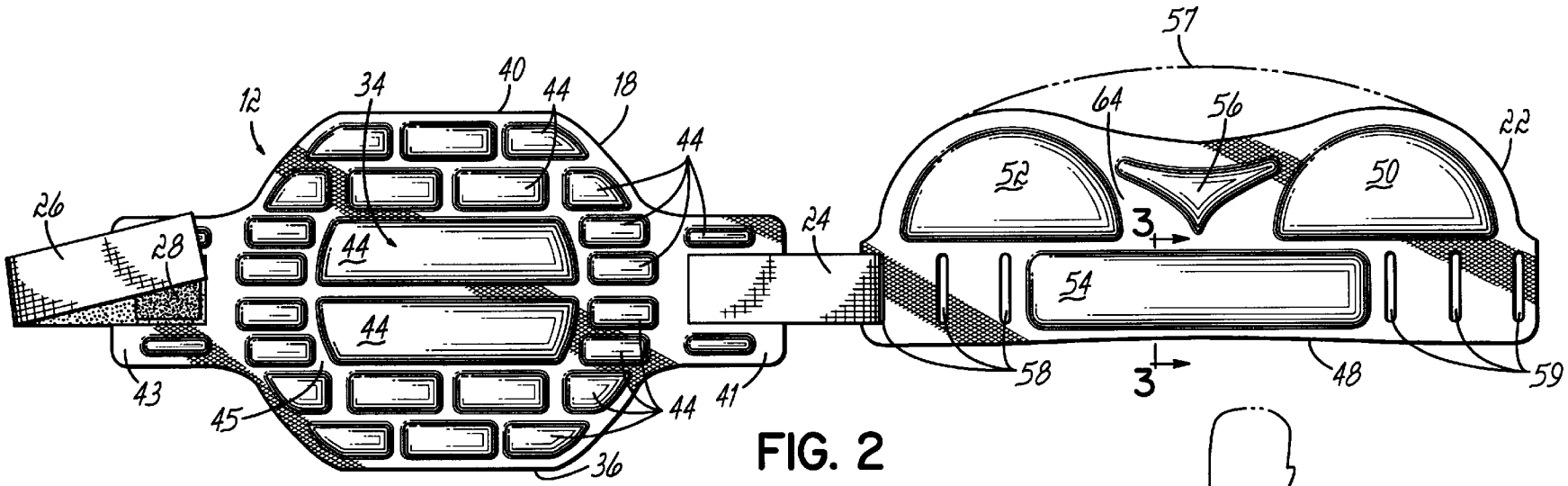
FIG. 2 is plan view of the soccer protective wear of the present invention.

14 of the soccer player 16 shown in phantom in FIG. 1. The protective wear 12 includes a front pad 18 and a rear pad 22. The front pad and rear pad are connected to each other by first and second elastic straps 24 and 26. Likewise, first and second elastic strips 24 and 26 include fasteners 28 (only one shown). As shown in the drawings, these are hook and pile fasteners such as Velcro brand fasteners which are ideally suited for soccer. Connectors such as snap fitments or any device which has a hard member would be unacceptable for soccer wear.

The front pad 18 includes a protective area 34 and has a bottom edge 36 which is adapted to extend to just slightly above the groin area 38 of the soccer player 16 and an upper edge 40 which is adapted to extend to or slightly below the rib cage area 42 of the soccer player 16. The protective area 34 includes a plurality of raised foam pockets 44 separated by non-raised areas 45. The particular number and design of the foam pockets is a matter of choice but should substantially cover the entire protective area. Further, the front pad includes right and left tab portions 41 and 43. These tab portions connect to first elastic strap 24 and second elastic strap 26.

The rear panel 22 likewise includes a plurality of raised foam areas. It includes a bottom edge 48 which is adapted to rest at the waist 14 of the soccer player. This generally straight edge which does not extend down to the hip area, keeps the protective device in position when worn by a soccer player. Further, the rear member 22 includes first raised kidney pad and second raised kidney pad 50 and 52 respectively. These raised portions, which are covered with expanded foam material are adapted to cover the kidney area of an individual when the bottom edge rests on the waistline of the individual.

Likewise, the rear panel 22 includes an expanded foam area 54 adapted to protect the tail-bone and an intermediate triangular foam raised portion 56. As shown by phantom line 57, the upper area of the pad can be expanded as desired. However, it is preferable to maintain the area of the pad as small possible so that the pad itself does not extend above the kidney area thereby being less intrusive to the player.

The rear portion further includes a plurality of slots 58 and 59. The straps 24 and 26 each extend through one of these slots to attach the front panel 18 to the rear panel 22. The different slots enable the pads to be adjusted for the individual player so that one size can be used for a variety of different body sizes. Also, it allows the device to be adjusted to the desired comfort of the individual.

Figure 3:
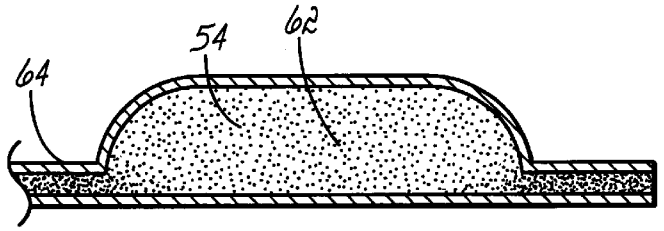
FIG. 3. is a cross-sectional view taken of lines 3—3 of FIG. 2.

The panels 18 and 22 are formed preferably from a foam material as shown in FIG. 3. The pads include a foam region 62 which is expanded in the raised areas such as area 54 and the areas between these portions such as area 64 and area 45 are non-expanded foam. Preferably both sides of the panel are covered by a soft fabric material such as a rayon, polyester or the like. A suitable continuous cross-linked polyethylene foam is sold by Sentinel Products Corporation of Hyannis, Mass. under the Trademark F-Cell®. Preferably a ⅜ inch non-foam material is used with a raised portion of approximately 1 inch will function well in the present invention As shown more particularly in FIG. 1, the protective gear 12 of the present invention is worn about the waist 14 of the soccer player 16. The elastic straps which are fixed to the tabs of the front panel extend through slots 58 and 59 respectively of the rear panel inter-fastened with hook and pile fasteners to provide a comfortable fit. This will encourage the player to wear the protective gear. These can be worn relatively loosely since the bottom edge of the rear panel rests on the waist-line of the individual holding the protective gear in position. Thus if an individual is kicked either in the abdominal area or the kidney area, the chances of serious injury are significantly reduced.

This has been a description of the present invention along with the preferred method of practicing the invention. However, the invention itself should only be defined by the appended claims wherein I claim:

1. Soccer protective wear comprising a front panel flexibly connected to a rear panel;

said front panel comprising a padded protective area configured to cover the stomach of a soccer player from slightly above the groin area of said soccer player to slightly below the rib-cage of said soccer player;

said rear panel having a bottom edge said rear panel adapted to rest on a waistline of said soccer player and extend upwardly at two kidney areas;

said two kidney areas each adapted to shield the kidney of said soccer player;

said front and rear panels connected by at least one elastic member;

whereby said protective wear is adapted to fit snugly around the soccer player without being attached directly to a soccer player's short or shirt.

2. The soccer protective wear claimed in claim 1 wherein said front and rear panels comprise flexible substrates supporting foamed areas.

3. The soccer protective wear claimed in claim 1 wherein said rear panel includes expanded foam areas at each of said kidney areas and at a central portion above said bottom edge.

4. The protective soccer wear claimed in claim 3 wherein said front panel is substantially covered with foamed areas.

5. The soccer protective wear claimed in claim 2 wherein said front pad is connected to said rear pad by first and second elastic members.

6. The soccer protective gear claimed in claim 5 wherein said first and second elastic members each include hook and pile type fasteners.

7. A method of protecting oneself while playing soccer comprising wherein said soccer protective gear claimed in claim 1 is worn around the waist beneath the outer-most layer of clothing of said soccer player and without being attached to any other garment worn by said soccer player.

* * * * *